US005379839A

United States Patent [19]

Hisaw

[11] Patent Number: 5,379,839

[45] Date of Patent: Jan. 10, 1995

[54] WELL TESTING VALVE

[75] Inventor: Jack Hisaw, Scott, La.

[73] Assignee: Specialty Machine & Supply, Inc., Scott, La.

[21] Appl. No.: 160,409

[22] Filed: Dec. 2, 1993

Related U.S. Application Data

[63] Continuation-in-part of Ser. No. 898,118, Jun. 12, 1992, Pat. No. 5,318,120.

[51] Int. Cl.[6] ..... E21B 34/14

[52] U.S. Cl. ..... 166/250; 166/332; 166/386

[58] Field of Search ..... 166/250, 386, 332, 334

[56] References Cited

U.S. PATENT DOCUMENTS

| | | | |
|---|---|---|---|
| 4,355,685 | 10/1982 | Beck | 166/240 |
| 4,508,174 | 4/1985 | Skinner et al. | 166/373 |
| 4,583,592 | 4/1986 | Gazda et al. | 166/250 |
| 4,669,537 | 6/1987 | Rumbaugh | 166/113 |
| 4,790,378 | 12/1988 | Montgomery et al. | 166/66 |
| 4,830,107 | 5/1989 | Rumbaugh | 166/250 |
| 4,842,064 | 6/1989 | Gazda | 166/250 |

*Primary Examiner*—William P. Neuder
*Attorney, Agent, or Firm*—C. Dean Domingue

[57] ABSTRACT

A well testing valve for obtaining a pressure build-up survey from a well bore intersecting a reservoir, the well bore containing a landing receptacle, is disclosed. The well testing valve comprises locking means for locking the well testing valve in the landing receptacle, valve means for selectively opening and closing the well bore. Also included is a rotational power source including a control means for selectively opening and closing the well bore, and recording means for recording the bottom hole pressure and temperature.

8 Claims, 9 Drawing Sheets

WELL TESTING VALVE

This application is a continuation-in-part of currently pending application Ser. No. 07/898,118, filed Jun. 12, 1992, now U.S. Pat. No. 5,318,120.

BACKGROUND OF THE INVENTION

This invention relates to well testing valves. More particularly, but not by way of limitation, this invention relates to down hole well testing valves used to obtain pressure build-up test data from a reservoir.

In order to obtain optimum production from a reservoir, bottom hole pressure surveys are routinely performed in order to determine pertinent reservoir characteristics. As those of ordinary skill in the art will appreciate, pressure build-up test are performed throughout the life of the reservoir, which includes immediately after discovery, and also after the reservoir has been placed on secondary or tertiary recovery. These tests generally comprise a flow period, a shut-in period, followed by other flowing, and shut-in periods.

Important data is obtained during both the flowing and build-up periods. Various test can be designed such that the duration and number of flowing and build-up periods depend on the individual characteristics of the reservoir.

Another important consideration is the location of the pressure gauge in the work string being utilized. Generally, it is most desirable to have the bottom hole pressure and temperature gauges as close to the reservoir as possible in order to alleviate problems such as well bore storage and flow-back when changing the test mode from flowing to shut-in.

A significant number of reservoirs are thousands of feet deep. Therefore, in designing a pressure test, an important feature is the location of the pressure and temperature gauges.

Various designs have been attempted in the prior art. For instance, in U.S. Pat. No. 4,583,592 to Gazda, the application discloses a well test tool for closing a well at a down hole location below the well packer and near the formation to be tested. The apparatus is openable and closeable from the surface by tensioning and then relaxing the cable. The test tool has a lock mechanism which locks automatically upon entering the landing receptacle in the well bore.

In U.S. Pat. No. 4,842,064 to Gazda, the specification discloses an apparatus including a landing receptacle for placing in a well bore, preferably near the well packer, and a well test tool lowerable with instrumentations into the tubing on a flexible line and anchorable in the landing receptacle, the test tool then being operational between open and closed positions by tensioning and relaxing the flexible line to open and close the well at the down hole location.

Another well test tool is disclosed in U.S. Pat. No. 4,830,107 to Rumbaugh. The tool includes a valve lowerable into a well on a flexible line and locked and sealed in a down hole landing receptacle, the valve being openable and closable to permit or prevent flow therethrough, well pressures below the test tool being sensed and recorded by a recording pressure gauge both during periods of flow and during shut-in periods.

Also, attention is drawn to U.S. Pat. No. 4,669,537, wherein a test tool including a locking device installed in a landing receptacle, and a sleeve valve with a recording instrument attached thereto is claimed. Therefore, there are numerous designs which have been attempted with regard to attaching a down hole valve to a landing receptacle, and pressure testing the intersecting reservoir. However, the prior art designs suffer from the ability of being able to set the valve in the landing receptacle, flowing the well, and re-entering the well bore with a closing device while the well is flowing, and shutting-in the reservoir.

Therefore, an object of this invention is to provide a bottom hole pressure assembly to be landed in a landing receptacle of a well bore near a reservoir, and be able to obtain multiple flowing and shut-in pressure surveys.

SUMMARY OF THE INVENTION

Accordingly a well testing valve for testing a reservoir is described. The well testing valve comprises: a tubular housing, a valve head, an equalizing dart, a coupling means and four seal means.

The tubular housing has at least one flow port in fluid communication between its outer and inner surface.

The valve head is slidably disposed within the tubular housing. The sidewall of the valve head has a first and second circumferential recess. The circumferential recesses are spaced a distance apart greater than the diameter of the flow port. The valve head also includes a longitudinal aperture running between its first and second valve face, and a radial aperture running between the longitudinal aperture and a portion of the valve sidewall located between the first and second circumferential recesses.

The equalizing dart is used to allow the pressure between the reservoir and the working string to equalize before opening the valve. The pressure equalization is accomplished by opening a small aperture between the shut-in reservoir and the working string for a period of time sufficient for the equalization to occur. Once the equalization is achieved the valve head blocking the flow port can be moved.

The equalizing dart includes a portion slidably disposed within the longitudinal aperture of the valve head and means for imparting linear motion to the valve head. The sidewall of the dart has a third and fourth circumferential recess which are spaced a distance apart greater than the diameter of the radial aperture.

The equalizing dart also includes a first and at least one second equalizing aperture. The first equalizing aperture passes through the front end of the dart and is in fluid communication with working string. The second equalizing aperture(s) is in fluid communication between the first equalizing aperture and a portion of the dart sidewall located between the front end of the dart and the third circumferential recess. The rear end of the equalizing dart is mechanically connected to a coupling means.

The coupling means converts rotational motion into linear motion. A first portion of the coupling means is mechanically connected with the rear end of the equalizing dart. A second portion of the coupling means is adapted for connection with a source of rotational power.

A first seal means is positioned within the first circumferential recess to form a sliding fluid-tight seal between the inner surface of the tubular housing and the valve sidewall.

A second seal means is positioned within the second circumferential recess to form a second sliding fluid-tight seal between the inner surface of the tubular housing and the valve sidewall.

A third seal means is positioned within the third circumferential recess to form a sliding fluid-tight seal between an inner surface of the longitudinal aperture and the dart sidewall.

A fourth seal means is positioned within the fourth circumferential recess to form a sliding fluid-tight seal between an inner surface of the longitudinal aperture and the dart sidewall.

In a preferred embodiment, the equalizing dart further includes a first dart stop means for limiting the motion of the equalizing dart within the longitudinal aperture in a first direction, and a second dart stop means for limiting the motion of the equalizing dart within the longitudinal aperture in a second direction. The first and second dart stop means allow the equalizing dart to move within the longitudinal aperture in a manner such that when the first dart stop means limits the motion of the equalizing dart within the longitudinal aperture in the first direction, the radial aperture is in operational alignment with the second equalizing aperture; and when the second dart stop means limits the motion of the equalizing dart within the longitudinal aperture in the second direction, the radial aperture is in operational alignment with a portion of the dart sidewall lying between the third and fourth seal means.

In another preferred embodiment the coupling means includes a screw mechanism.

In another preferred embodiment the first seal means has a width greater than the diameter of the housing port(s), and the third seal means has a width greater than the diameter of the radial aperture(s).

Also described is a device for obtaining a pressure build-up survey from a well bore intersecting a reservoir when the well bore contains a landing receptacle with a seal bore. The device comprises: a locking means; an embodiment of the above described well testing valve, in mechanical connection with the locking means; and a recording means, mechanically connected to the well testing valve, for recording bottom hole pressure.

The locking means locks the device in the landing receptacle and contains a set of seals positioned within the seal bore of the landing receptacle.

DESCRIPTION OF THE PREFERRED EMBODIMENTS

Figure 1:
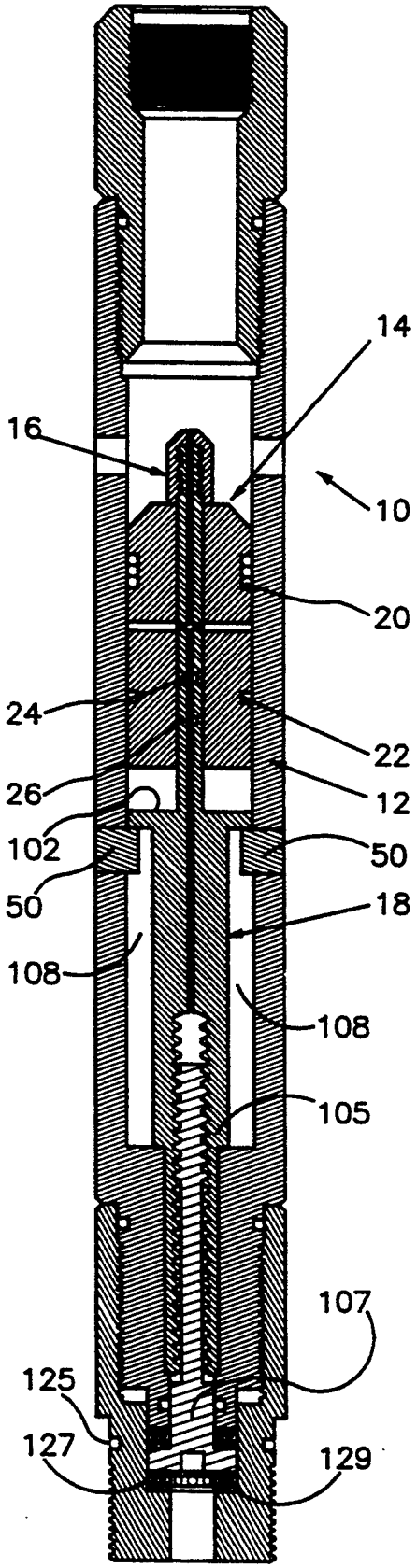
FIG. 1 is a cross-sectional view of a completely assembled preferred embodiment of the well testing valve of the present invention in the fully opened position.

FIG. 1 shows a preferred embodiment of the well testing valve 10 of the present invention. The well testing valve 10 comprises: a tubular housing, generally indicated by the numeral 12; a valve head, generally indicated by the numeral 14; an equalizing dart, generally indicated by the numeral 16; a coupling means, generally indicated by the numeral 18; and a first, second, third and fourth seal means generally indicated by the numerals 20, 22, 24, and 26 respectively.

Figure 2:
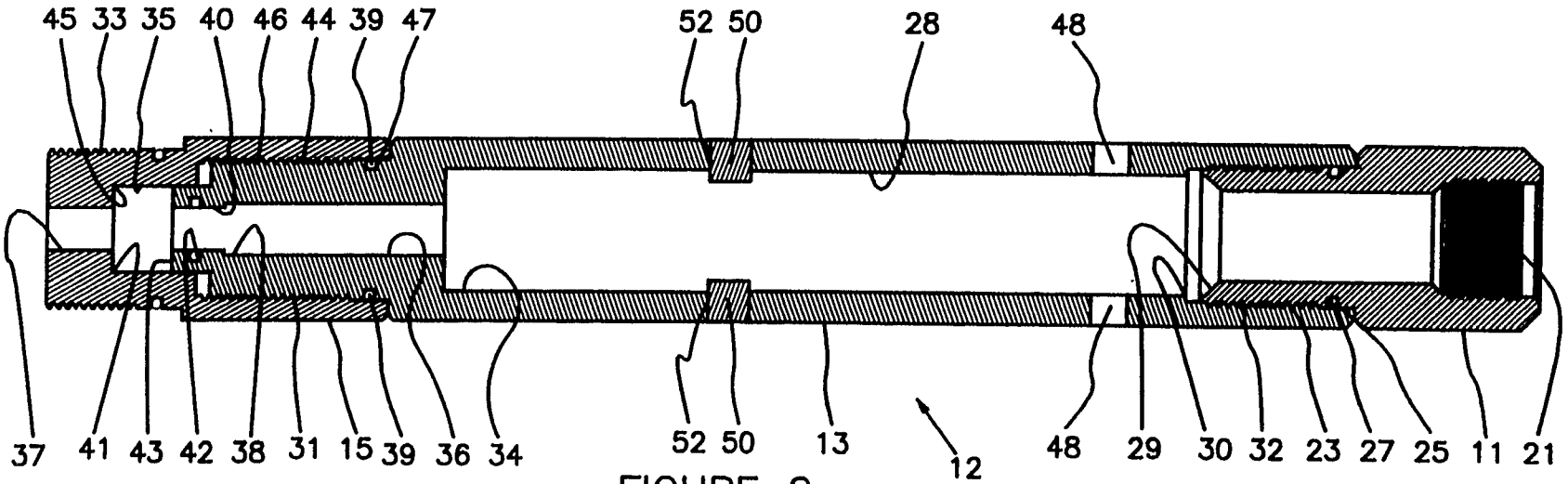
FIG. 2 is a cross-sectional view of a preferred tubular housing.

FIG. 2 shows a cross-section of a preferred tubular housing 12 in isolation. In this preferred embodiment, the tubular housing 12 is constructed of three threadably connected sections: a front section 11, a central section 13 and a rear section 15.

The central section 13 includes a smooth central bore 28. The central bore 28 terminates at its first end 30 in connection with the internally threaded end 32 of the central section 13, and at its second end 34 in connection with the axially aligned coupling bore 36.

The coupling bore 36 has a smaller diameter than the central bore 28 and is connected at its other end 38 with the axially aligned seal bore 40. The seal bore 40 has a smaller diameter than the coupling bore 36 and includes a circumferential recess 42 for receiving a seal (not shown). A portion of the exterior 44 of the central section 13 surrounding the coupling bore 36 is of a smaller diameter than the rest of the exterior of the central section 13 and includes a threaded portion 46 and a circumferential recess 47 for receiving a seal (not shown). The seal bore 40 terminates at its other end at a first bearing surface 43 which is perpendicular to the axis of the seal bore 40.

Located toward the first end 30 of the central bore 28 are four ports 48 which are of a diameter sufficient to allow a desired quantity of production flow therethrough. In this preferred embodiment each of the ports 48 is about ??? mm in diameter. Although this preferred embodiment includes four ports 48, it is only necessary to have one port 48 in order to practice the invention.

The metal coupling guide plugs 50 are also part of the central section 13. The coupling guide plugs 50 extend into the central bore 28. During construction of the well testing valve 10, they are inserted through the welding guide plug receiving apertures 52 and welded in place. The purpose of the coupling guide plugs 50 is to prevent rotation of the coupling means during operation.

The front section 11 of the tubular housing 12 includes an internally threaded end 21 and an externally threaded end 23. The externally threaded end 23 includes a circumferential recess 25 to allow for installation of an O-ring 27. The front section 11 is threadably connected to the central section 13 by threading the externally threaded end 23 into the internally threaded end 32 of the central section 13. As shown in FIG. 2, the externally threaded end 23 of the front section 11 has a chamfered edge 29.

The rear section 15 of the tubular housing 12 includes an internally threaded section 31, an externally threaded section 33, a bearing housing bore 35 and a shaft bore 37. The rear section 15 is attached to the central section 13 by installing an O-ring 39 in the circumferential recess 47 and then threading the internally threaded section 31 onto the threaded portion 46 surrounding the coupling bore 36.

The bearing housing bore 35 terminates at one end 41 in a bearing surface 45 which is perpendicular to the axis of the bearing housing bore 35. The length of the bearing housing bore 35 is selected to allow a portion of the coupling means and two sets of thrust bearings (not shown) to be housed therein when the central and rear sections 13,15 of the tubular housing are connected. Although thrust bearing are used to reduce rotational friction in this preferred embodiment, any method, well known in the art, of reducing rotational friction such as packing with grease is sufficient to practice the invention.

The diameter of the shaft bore 37 is selected to allow the shaft of a desired source of rotational power (not shown) to pass therethrough and connect with the coupling means 18.

The externally threaded section 33 is adapted to allow connection of the well testing valve with the housing of a desired source of rotational power (not shown).

Figure 3:
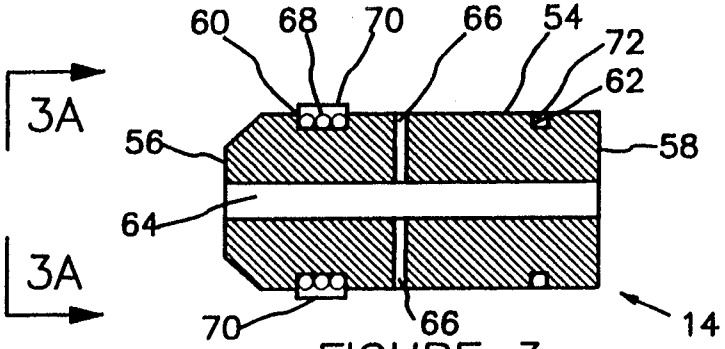
FIG. 3 is a cross-sectional view of a preferred valve head.
Figure 3A:
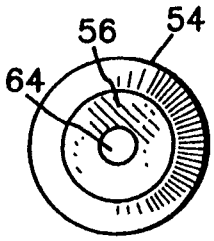
FIG. 3A is a frontal view of the preferred valve head of FIG. 3 along the line 3A—3A.

FIG. 3 is a cross-sectional view of a preferred valve head 14. The valve head 14 is generally cylindrical in shape and is of a diameter which allows the valve head 14 to slide within the central bore 28 of the central section 13. The valve head 14 includes a sidewall 54, a front valve face 56, and a rear valve face 58. FIG. 3A is a frontal view of the valve head 14 shown in FIG. 3.

The sidewall 54 has a first and second circumferential recess 60, 62. The first circumferential recess 60 is located nearer the front valve face 56 and is of a width greater than the diameter of the ports 48. The second circumferential recess 62 is located a distance, from the first circumferential recess 60 in a direction toward the rear valve face 58, which is greater than the diameter of the ports 48.

Positioned within the first circumferential recess 60 is a first seal means for providing a first sliding fluid-tight seal between the central bore 28 and the sidewall 54 of the valve head 14. In this preferred embodiment the first seal means is three O-rings 68 which are covered by a teflon cap 70. The width of the teflon cap is selected to be greater than the diameter of the ports 48.

Positioned within the second circumferential recess 62 is a second seal means for providing a second sliding fluid-tight seal between the central bore 28 and the sidewall 54 of the valve head 14. In this preferred embodiment the second seal means is an O-ring 72.

The valve head 14 also includes a longitudinal aperture 64 and four radial apertures 66 (two not shown). The longitudinal aperture 64 has a smooth bore and connects the front valve face 56 to the rear valve face 58. The radial apertures 66 connect the longitudinal aperture 64 with a portion of the sidewall 54 lying between the first and second circumferential recesses 60,62. Although four radial apertures 66 are used in this preferred embodiment, only one radial aperture 66 is required to practice the invention.

Figure 4A:
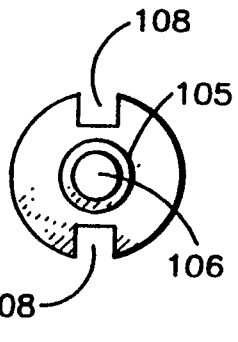
FIG. 4A is a rear view of the composite member of FIG. 4 along the line 4A—4A.
Figure 4:
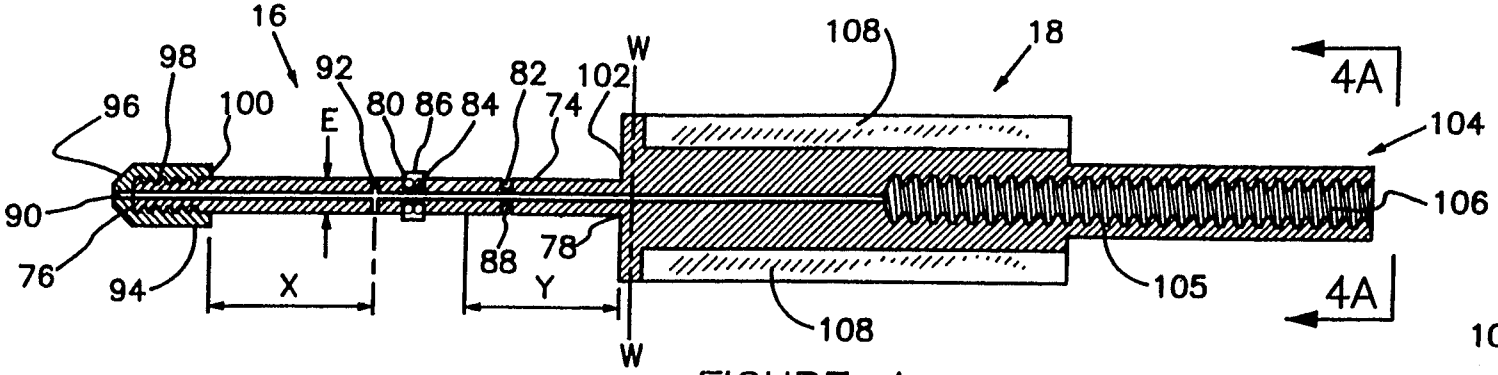
FIG. 4 is a cross-sectional view of a composite member containing a preferred equalizing dart and a first portion of a preferred coupling means.

With reference to FIG. 4. In this preferred embodiment, the equalizing dart 16 and a portion of the coupling means 18 are integrally joined at the location generally indicated by the line W—W. To the left of line W—W is shown the equalizing dart 16. To the right of line W—W is shown a portion of the coupling means 18.

The preferred equalizing dart 16 shown in FIG. 4 has a generally cylindrical shaped exterior having a diameter "E" which allows the equalizing dart 16 to slide within the longitudinal aperture 64 of the valve head 14. The equalizing dart 16 includes a sidewall 74, a front dart end 76, a rear dart end 78, and a dart cap 96.

The sidewall 74 has a third and fourth circumferential recess 80,82. The third circumferential recess 80 is located nearer the front dart end 76 and is of a width greater than the diameter of the radial apertures 66 of the valve head 14. The second circumferential recess 82 is located a distance, from the third circumferential recess 80 in a direction toward the rear dart end 78, which is greater than the diameter of the radial apertures 66 of the valve head 14.

Positioned within the third circumferential recess 80 is a third seal means for providing a first sliding fluid-tight seal between the longitudinal aperture 64 and the sidewall 74 of the equalizing dart 16. In this preferred embodiment the third seal means is two O-rings 84 which are covered by a teflon cap 86. The width of the teflon cap is selected to be greater than the diameter of the radial apertures 66.

Positioned within the fourth circumferential recess 82 is a fourth seal means for providing a second sliding fluid-tight seal between the longitudinal aperture 64 and the sidewall 74 of the equalizing dart 16. In this preferred embodiment the fourth seal means is an O-ring 88.

The equalizing dart 16 also includes a first equalizing aperture 90 and four second equalizing apertures 92 (two not shown). Although, to practice the invention, it is only necessary for the first equalizing aperture to connect the second equalizing aperture to the front dart end, in this preferred embodiment, the first equalizing aperture connects the front dart end 76 with a portion of the coupling means 18 and the second equalizing apertures 92. The second equalizing apertures 92 connect the first equalizing aperture 90 with a portion of the sidewall 74 lying between the front dart end 76 and the third circumferential recesses 80. Although this preferred embodiment includes four second equalizing apertures 92, it is only necessary to have one equalizing aperture 92 to practice the invention.

In order to facilitate assembly of the valve, the front dart end 76 includes a threaded portion 94 to allow attachment of the dart cap 96. Although the front dart end 76 in this preferred embodiment is adapted to allow the equalizing dart 16 to be inserted through the longitudinal aperture 64 during assembly, other methods such as threadably connecting the rear dart end 78 and the coupling means 18 or pressing the dart cap 96 onto the front dart end 76 as well as other connecting methods well known in the art are suitable to practice the invention.

The dart cap 96 has internal threads 98 and a front lip portion 100. When the dart cap 96 is threaded onto the front dart end 76, the front lip portion 100, which extends radially outward further than the diameter of the longitudinal aperture 64, will contact the front valve face 56 when the equalizing dart is drawn rearward by the coupling means 18. The distance "X" between the lip portion 100 and the location of the four second equalizing apertures 92 is selected such that when the front lip portion 100 contacts the front valve face 56 the second equalizing apertures 92 will be in operational alignment with the radial apertures 66 of the valve head 14. The term "operational alignment" is uses herein to denote that the apertures are in fluid communication.

As shown in FIG. 4, the rear dart end 78 includes a rear lip portion 102. The rear lip portion 102 extends radially outward further than the diameter of the longitudinal aperture 64. The rear lip portion 102 will contact the rear valve face 58 when the equalizing dart 16 is pushed forward by the coupling means 18. The distance "Y" between the rear lip portion 102 and that portion of the sidewall 74 of the equalizing dart 16 lying between the third and fourth circumferential recesses 80,82 is selected such that when the rear lip portion 102 contacts the rear valve face 58 the radial apertures 66 of the valve head 14 will be in operational alignment with that portion of the sidewall 74 of the equalizing dart 16 lying between the third and fourth circumferential recesses 80,82.

The purpose of the coupling means 18 is to convert rotational force into linear force. In this preferred embodiment, the coupling means 18 includes a screw mechanism 104. A first portion 105 of the screw mechanism 104 is shown in FIG. 4. This portion of the screw mechanism 104 includes an internally threaded bore 106 and two coupling guides 108.

The coupling guides 108 are dimensioned to slidably receive the coupling guide plugs 50. When the coupling guide plugs 50 are installed within the coupling guides 108, the first portion 105 of the screw mechanism 104 is prevented from rotating but is allowed to slide back and forth within the central bore 28.

The internally threaded bore 106 in this preferred embodiment, is in fluid communication with the first equalizing aperture 90 of the equalizing dart 16.

FIG. 4A is a rear view of the first portion 105 of the screw mechanism along the line 4A-4A and more clearly illustrates the coupling guides 108.

Figure 5A:
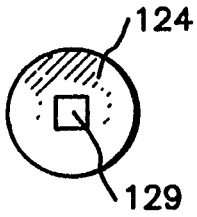
FIG. 5A is a rear view of the second portion of the coupling means of FIG. 5 along the line 5A—5A.
Figure 5:
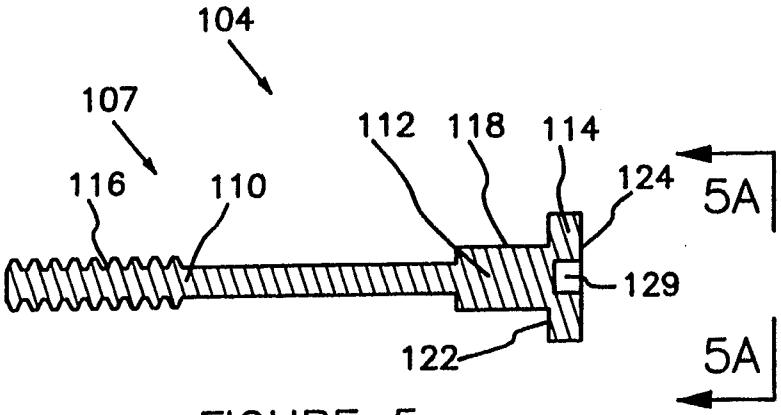
FIG. 5 is a cross-sectional view of a second portion of a preferred coupling means.

The second portion 107 of the screw mechanism 104 is shown in FIG. 5. The second portion 107 includes a drive section 110, a seal section 112 and a attachment section 114.

The drive section 110 includes a threaded portion 116 which is companionately threaded to mate with the internally threaded bore 106 of the first portion 105.

The drive section is mechanically connected with the seal section 112. The exterior 118 of the seal section 112 is generally cylindrical and is of a diameter which allows an O-ring 120, when installed within the circumferential recess 42 of the seal bore 40, to form a fluid-tight seal.

The attachment section 114 is also generally cylindrical and includes a slotted connection groove 129 and second and third bearing surfaces 122,124 which are perpendicular to the axis of the attachment section. During assembly of the well testing valve 10, thrust bearings 125, 127 (shown in FIGS. 6 and 7) are installed between the first and second bearing surface 43,122, and the third and fourth bearing surfaces 124, 45. (first and third bearing surfaces 43,45 are shown in FIG. 2)

The slotted connection groove 129 is adapted to allow for connection to the shaft of a rotational power source (not shown). In this preferred embodiment, the slotted connection groove 129, (more clearly shown in FIG. 5A) has a square shaped cross-section corresponding to the square shaped shaft of a desired source of rotational power.

OPERATION OF THE PREFERRED EMBODIMENT OF THE WELL TESTING VALVE

FIG. 1 is a cross-sectional view of the completely assembled preferred embodiment of the well testing valve 10. As it appears in FIG. 1, the well testing valve 10 is in the open position with the valve head 14 and the equalizing dart 16 in their fully retracted positions. In this position, fluid may enter the valve through ports 48 and flow out through the front section 11 of the tubular housing 12.

When it is desired to close the well testing valve 10, rotational power is supplied in a first rotational direction to the second portion 107 of the screw mechanism 104 through slotted connection groove 129. As the second portion 107 of the screw mechanism 104 rotates in the first rotational direction, the first portion 105 of the screw mechanism 104 begins to move forward because it is prevented from rotating by the coupling guide plugs 50 which are slidably installed within the coupling guides 108.

Figure 6:
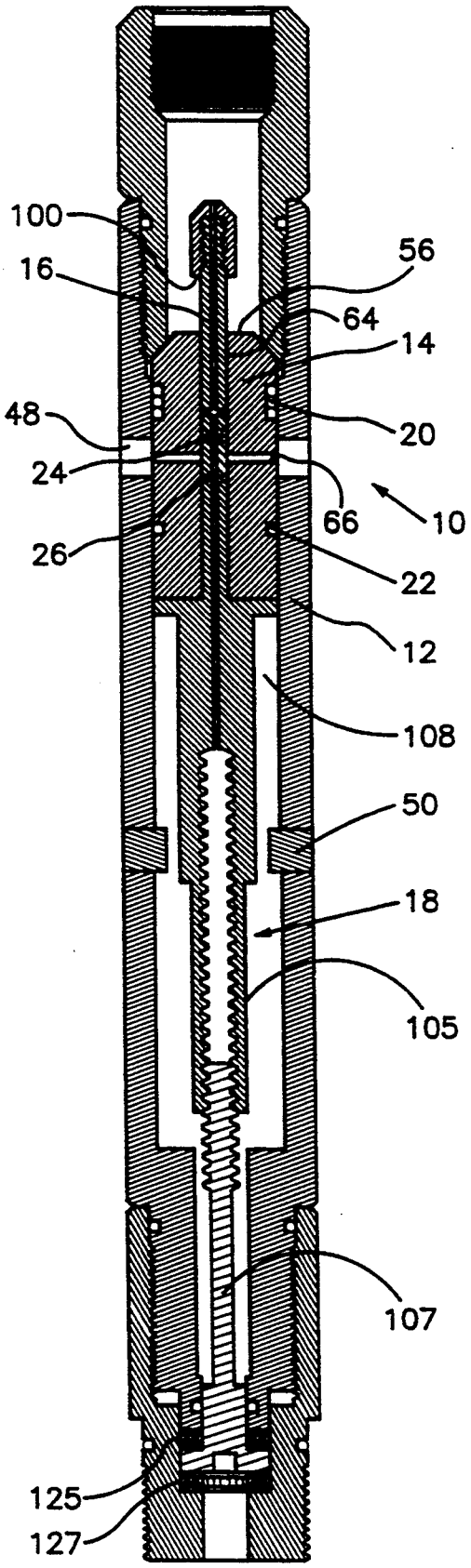
FIG. 6 is a cross-sectional view of a completely assembled embodiment of a preferred embodiment of the well testing valve of the present invention in the fully closed position.

As the first portion 105 moves forward, the equalizing dart 16, which is mechanically connected to the first portion 105, also moves forward. Because the equalizing dart 16 is slidable within the longitudinal aperture 64 of the valve head 14, the equalizing dart 16 moves forward while the valve head 14 remains stationary. When the rear lip portion 102 of the equalizing dart 16 contacts the rear valve face 58 of the valve head 14, the valve head 14 is forced forward along with the equalizing dart, until the valve head 14 reaches the fully closed position shown in FIG. 6. As shown in FIG. 6, when the valve head 14 and the equalizing dart 16 are in this configuration, the exterior ends of the radial apertures 66 of the valve head 14 are in operational alignment with the ports 48 and the interior ends of the radial apertures 66 are in operational alignment with the portion of the equalizing dart 16 sidewall 74 lying between the third and fourth seal means 24,26. Thus, there is no path for fluid to flow through the well testing valve 10 and the well testing valve is in the closed position.

In use, when the well testing valve 10 is in the closed position and the reservoir is shut-in, pressure begins to build in the reservoir, creating a substantial pressure differential between the working line pressure seen by the front valve face 56 and reservoir pressure seen at the ports 48. This pressure differential must be minimized before opening the well testing valve in order to prevent damage to the seals and in order to allow the well testing valve 10 to be opened with a lower powered source of rotational power.

Opening the well testing valve 10 is a two step process. The first step is minimizing the pressure differential between the working line pressure seen by the front valve face 56 and reservoir pressure seen at the ports 48. The second step is moving the valve head 14 rearward until the ports 48 are no longer blocked.

The first step in opening the well testing valve is accomplished by supplying rotational power in a second rotational direction to the second portion 107 of the screw mechanism 104 through the slotted connection groove 129. As the second portion 107 of the screw mechanism 104 rotates in the second rotational direction, the first portion 105 of the screw mechanism 104 begins to move rearward because it is prevented from rotating by the coupling guide plugs 50 which are slidably installed within the coupling guides 108.

As the first portion 105 moves rearward, the equalizing dart 16, which is mechanically connected to the first portion 105, also moves rearward. Because the equalizing dart 16 is slidable within the longitudinal aperture 64 of the valve head 14, the equalizing dart 16 moves rearward while the valve head 14 remains stationary until the front lip portion 100 of the equalizing dart 16 contacts the front valve face 56 of the valve head 14. Once the front lip portion 100 of the equalizing dart 16 contacts the front valve face 56 of the valve head 14 the supply of rotational power is stopped.

Figure 7:
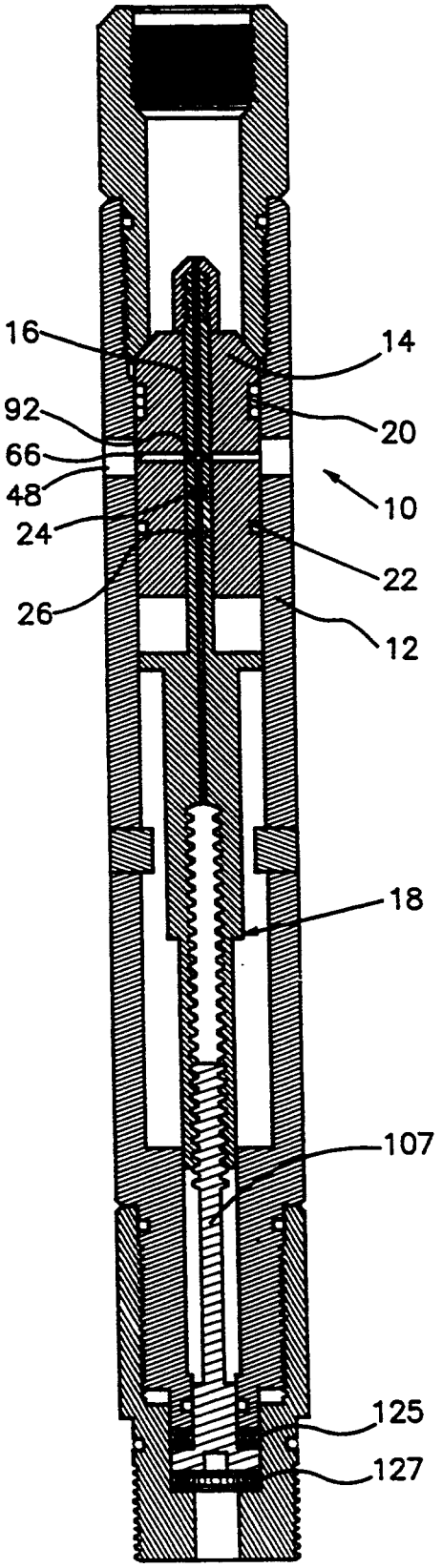
FIG. 7 is a cross-sectional view of a completely assembled embodiment of a preferred embodiment of the well testing valve of the present invention in the equalizing position.

As shown in FIG. 7, when the valve head 14 and the equalizing dart 16 are in this position, the exterior ends of the radial apertures 66 of the valve head 14 are in operational alignment with the ports 48 and the interior ends of the radial apertures 66 are in operational alignment with the second equalizing apertures 92 of the equalizing dart 16. Thus, there is a path for fluid to flow through the well testing valve 10 and pressure differential between the reservoir and the working line begins to equalize. The well testing valve 10 is left in this configuration until the pressure differential is minimized. The amount of time required to minimize the pressure differential is a function of several variables. It has been found by the inventor's hereof that a thousand pound differential can be minimized using four 1/16 inch diameter second equalizing 92 apertures in about 4 hours. Once the pressure differential has been minimized the first step is complete.

The second step of the two step well testing valve opening process is accomplished by again supplying rotational power in a second rotational direction to the second portion 107 of the screw mechanism 104 through the slotted connection groove 129. This causes the valve head 14 to be drawn rearward into the position shown in FIG. 1. Once the valve head 14 reaches this position, the rotational power supply is shut off and the well testing valve is in the fully open position.

WELL TESTING APPLICATION

Figure 8:
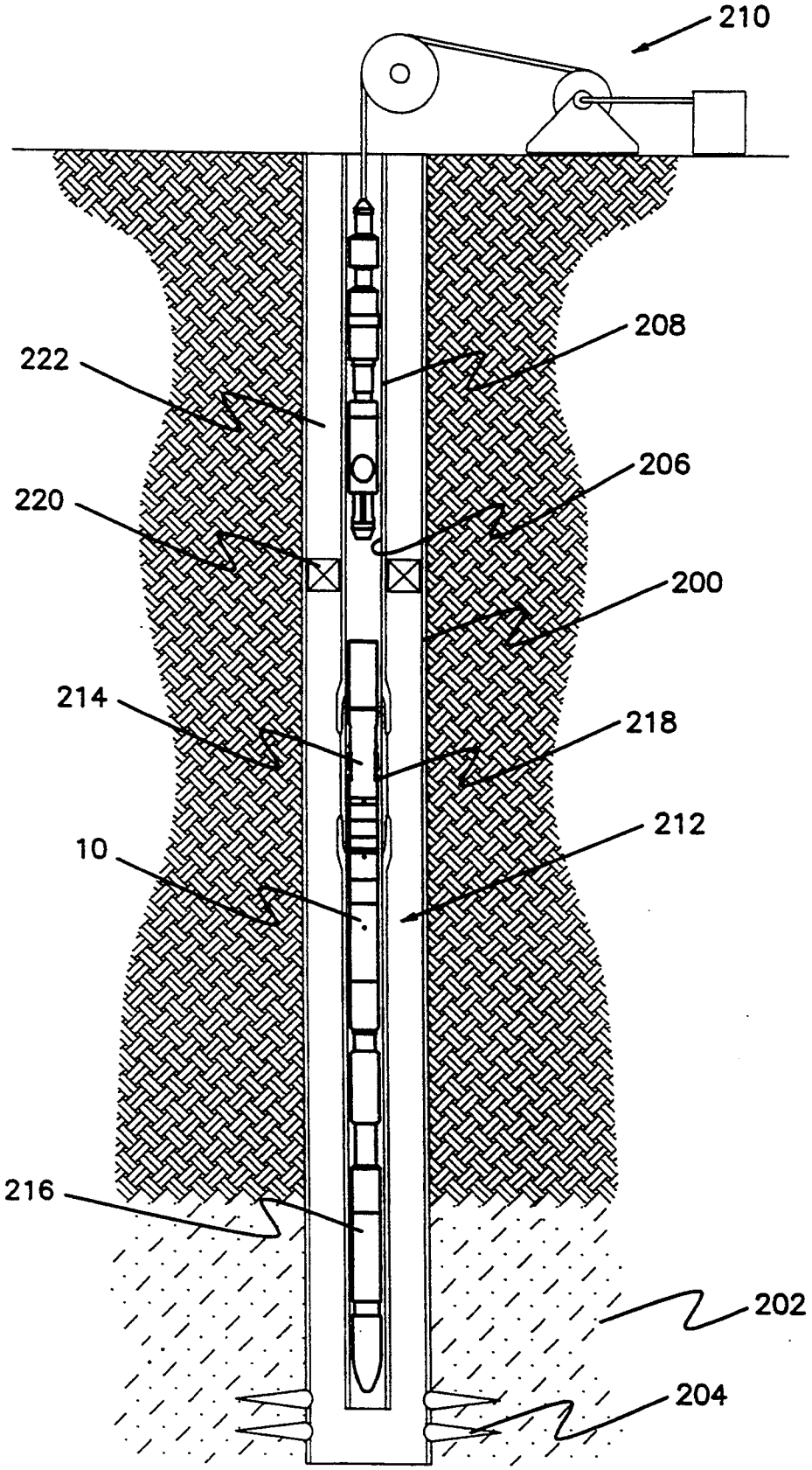
FIG. 8 is a schematic view of a well bore intersecting a reservoir.

Referring to FIG. 8, a schematic view of a well bore 200 intersecting a reservoir 202 is depicted. In the preferred embodiment, the reservoir 202 will be hydrocarbon bearing, and will contain perforations 204 which will communicate the reservoir with the internal diameter 206 of the work string 208. A representative wire line unit is shown at 210.

The work string 208 will generally be a tubing string. However, it should be understood that the invention will be operative with other work strings such as drill pipe. The work string will be connected to surface facilities (not shown) for the production and separation of oil, gas and water from the reservoir 202.

The down hole tool of the present invention is shown generally at 212. The tool 212 will comprise of a locking device 214, a well testing valve 10, a rotational power unit 215, and a pressure and temperature means 216 for reading and recording the pressure and temperature of the reservoir. The locking device is positioned within a landing receptacle 218, with the landing receptacle being threadably attached to the work string 208.

A packer means 220 is also depicted wherein the packer is positioned within the well bore so that the annulus area 222 is sealed from the pressure of the perforations 204. Therefore, flow from the reservoir 202 progresses from the perforations 204, through the down hole tool 212 (when the valve 10 is opened), and through the internal diameter 206 of the work string 208 to the surface facilities.

Figure 9:
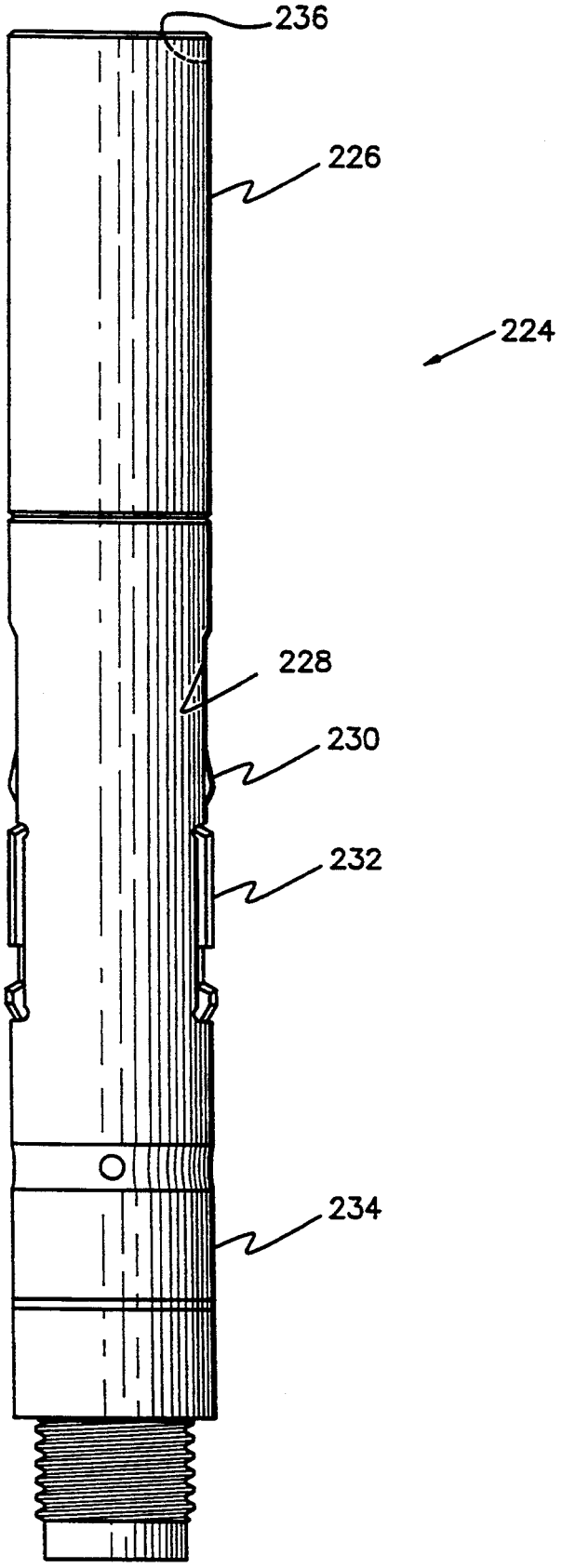
FIG. 9 is a side view of a typical lock device.

Referring now to FIG. 9, a typical lock device 224 is shown, which is equivalent to the locking device 214 shown in FIG. 8. It should be understood that different types of locking devices can be employed. The purpose of a locking device is to locate in the landing receptacle (which is attached and made a part of the work string), and then have the locking device remain attached in the landing receptacle. In the industry, there are different types of locking devices, and the embodiments of the present invention can easily be adapted to be operative with them.

For example, an "x" locking device is depicted in FIG. 4; the term "X" locking device is a trademark of Otis. However, locking devices such as a Baker "F" or "R" or a Camco "M" or "C" could be used. The actual locking device chosen simply depends on the type of landing device which is in the well, and other well design characteristics such as work string size.

The locking device 224 will generally comprise a cylindrical body 226 having openings 228 that will have key springs 230 and keys 232 disposed therethrough. The body 226 will also have seal means 234, which in the preferred embodiment will be packing elements, for creating a seal in the seal bore of the landing receptacle 218. Extending radially inward will be the fishing neck 236 which allows for retrieval of the locking device 224.

Figure 10:
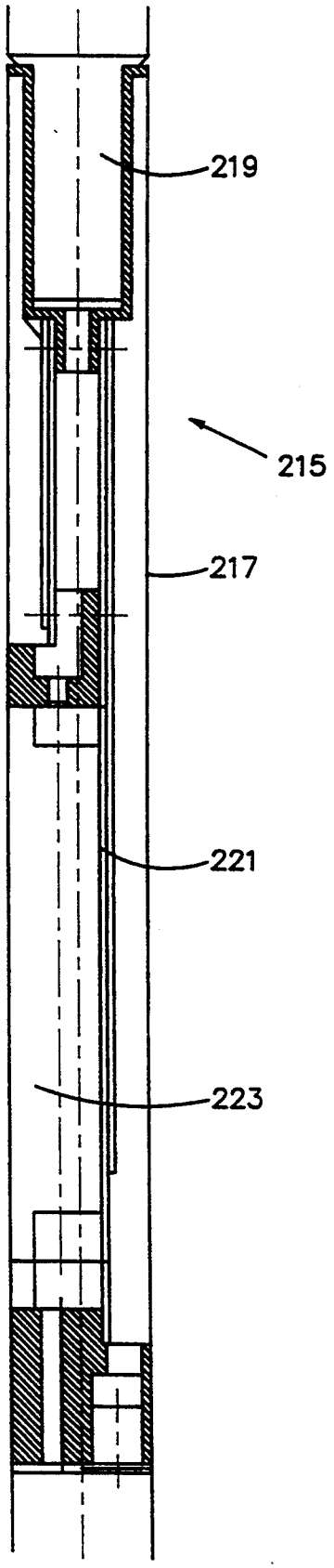
FIG. 10 is a side view of a typical rotational power source.

The rotational power source 215 comprises: a housing 217, a motor 219, a programmable motor controller 221, and a power supply 223. FIG. 10 shows a preferred rotational power source 215. The rotational power source 215 used in this preferred embodiment is a DHSIT-V.5 which is available from Z.I. Probes, Edmonton Canada.

Figure 11:
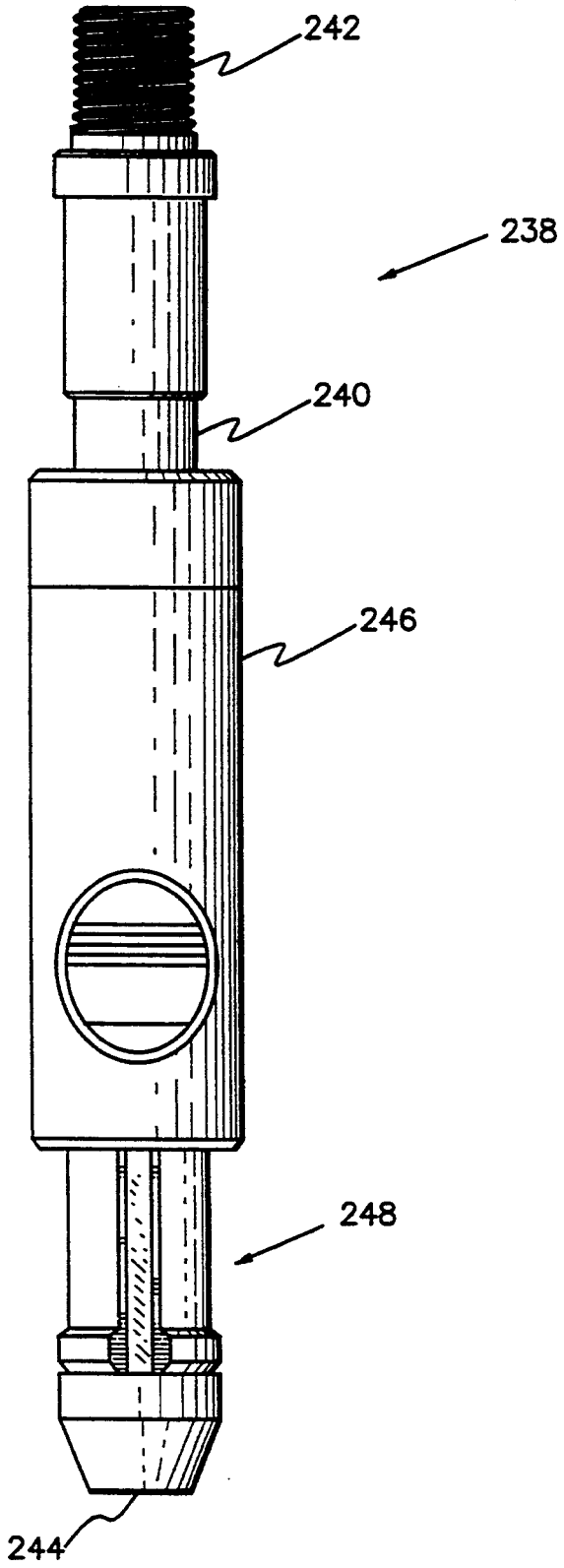
FIG. 11 is a side view of a typical pulling tool.

Referring to FIG. 11, a typical device which is used to retrieve the locking device 224 is a pulling tool 2238. As is the case with the locking tool, there are different types available in the industry, such as the "R", "S" or "JDC". The pulling tool may comprise an inner core barrel 240, with the barrel 240 having a fishing neck 242 disposed on one end, and a prong end 244 disposed on the other. The pulling tool will also have an outer mandrel 246 disposed about the inner core barrel 240, and disposed between the mandrel 246 and the core 240 are dogs 248, which are utilized to collapse the keys 232 of the locking device.

OPERATION

The operation of the down hole tool 212 will now be discussed. The bottom hole assembly will generally be run into the well bore 208 on wire line. It should be appreciated that the bottom hole assembly can also be run on either electric line, or coiled tubing, depending on the choice of the operator.

The down hole tool 212 will be run into the well bore 200 with the valve in the open position as depicted in FIG. 1. The tool 212 will be secured to the locking device 214, and will be run past the landing receptacle 218. At this point, the keys 232 will contract, or collapse, as the locking device is run through the landing receptacle 218; this process is known as locating the locking device 214 in the receptacle 218.

Next, the locking device 214 is positioned in the receptacle such that the keys 232 will anchor the assembly to the landing receptacle 218. Further, the seal means 234 will be engaged in the seal bore of the landing receptacle 218.

The well bore, at the surface, can then be opened to flow to the production facilities, and a flowing survey can then be established, with the pressure means 216 recording the flowing bottom hole pressure. Once a sufficient flowing period has been completed, the motor control means will operate the motor in the direction which will effectively close the well bore to flow, and thus, a pressure build-up can then commence, with the pressure means recording the down hole pressure.

Once a sufficient build-up pressure has been obtained and the pressure measured and recorded, the well testing valve may be opened as described previously.

Thus, by continued closing and opening of the valve, a series of pressure build-up data may be developed.

When it is no longer desired to obtain pressure data, the entire down hole tool can be pulled out of the hole. This may be accomplished by positioning the pulling tool 238 in the well bore 200. The core 240 which contains the collapsing dogs 248 will enter the inter diameter of the lock device 214. As will be appreciated by those of ordinary skill in the art, the dogs 248 will collapse the keys 232 and further engage the fishing neck 236 of the lock device 214 which will allow for the removal of the down hole tool from the well bore.

Once retrieved to the surface, the pressure means can be read by surface computer means, and determined whether any further pressure transient test are required.

Changes and modifications in the specifically described embodiments can be carried out without departing from the scope of the invention which is intended to be limited only by the scope of the appended claims.

What is claimed is:

1. A well testing valve for testing a reservoir comprising:

a tubular housing having an outer surface, an inner surface, and a port in fluid communication between said outer and inner surface;

a valve head, slidably disposed within said tubular housing, having a first and second valve face and a valve sidewall, said valve sidewall defining a first and second circumferential recess, said first and second circumferential recesses being spaced a distance apart greater than the diameter of said port, said valve head including a longitudinal aperture in fluid communication between said first and second valve face, and a radial aperture in fluid communication between said longitudinal aperture and a portion of said valve sidewall located between said first and second circumferential recesses;

an equalizing dart having a portion slidably disposed within said longitudinal aperture of said valve head and means for imparting linear motion to said valve head, said equalizing dart having a first and second dart end and a dart sidewall, said dart sidewall defining a third and fourth circumferential recess, said third and fourth circumferential recesses being spaced a distance apart greater than the diameter of said radial aperture, said equalizing dart including a first and second equalizing aperture, said first equalizing aperture being in fluid communication with said first dart end, said second equalizing aperture being in fluid communication between said first equalizing aperture and a portion of said dart sidewall located between said first dart end and said third circumferential recess, said second end of said equalizing dart being in mechanical connection with a coupling means;

a coupling means for converting rotational motion into linear motion, said coupling means having a first portion in mechanical connection with said second end of said equalizing dart and a second portion adapted for connection with a source of rotational power;

a first seal means, disposed within said first circumferential recess, for forming a sliding fluid-tight seal between said inner surface of said tubular housing and said valve sidewall;

a second seal means, disposed within said second circumferential recess, for forming a sliding fluid-tight seal between said inner surface of said tubular housing and said valve sidewall;

a third seal means, disposed within said third circumferential recess, for forming a sliding fluid-tight seal between an inner surface of said longitudinal aperture and said dart sidewall; and a fourth seal means, disposed within said fourth circumferential recess, for forming a sliding fluid-tight seal between an inner surface of said longitudinal aperture and said dart sidewall.

2. The well testing valve of claim 1 wherein said equalizing dart further includes a first dart stop means for limiting the motion of said equalizing dart within said longitudinal aperture in a first direction, and a second dart stop means for limiting the motion of said equalizing dart within said longitudinal aperture in a second direction; said first and second dart stop means allowing said equalizing dart to move within said longitudinal aperture in a manner such that, when said first dart stop means limits the motion of said equalizing dart within said longitudinal aperture in said first direction, said radial aperture is in operational alignment with said second equalizing aperture; and, when said second dart stop means limits the motion of said equalizing dart within said longitudinal aperture in said second direction, said radial aperture is in operational alignment with a portion of said dart sidewall lying between said third and fourth seal means.

3. The well testing valve of claim 2 wherein said coupling means includes a screw mechanism.

4. The well testing valve of claim 2 wherein said first seal means has a width greater than the diameter of said port of said tubular housing, and said third seal means has a width greater than the diameter of said radial aperture.

5. A device for obtaining a pressure build-up survey from a well bore intersecting a reservoir, the well bore containing a landing receptacle with a seal bore, the device comprising:

locking means for locking the device in the landing receptacle, said locking means containing a set of seals positionable within the seal bore of the landing receptacle;

a well testing valve in mechanical connection with said locking means, said well testing valve comprising:

a tubular housing having an outer surface, an inner surface, and a port in fluid communication between said outer and inner surface;

a valve head, slidably disposed within said tubular housing, having a first and second valve face and a valve sidewall, said valve sidewall defining a first and second circumferential recess, said first and second circumferential recesses being spaced a distance apart greater than the diameter of said port, said valve head including a longitudinal aperture in fluid communication between said first and second valve face, and a radial aperture in fluid communication between said longitudinal aperture and a portion of said valve sidewall located between said first and second circumferential recesses;

an equalizing dart having a portion slidably disposed within said longitudinal aperture of said valve head and means for imparting linear motion to said valve head, said equalizing dart having a first and second dart end and a dart sidewall, said dart sidewall defining a third and fourth circumferential recess, said third and fourth circumferential recesses being spaced a distance apart greater than the diameter of said radial aperture, said equalizing dart including a first and second equalizing aperture, said first equalizing aperture being in fluid communication with said first dart end, said second equalizing aperture being in fluid communication between said first equalizing aperture and a portion of said dart sidewall located between said first dart end and said third circumferential recess, said second end of said equalizing dart being in mechanical connection with a coupling means;

a coupling means for converting rotational motion into linear motion, said coupling means having a first portion in mechanical connection with said second end of said equalizing dart and a second portion adapted for connection with a source of rotational power;

a first seal means, disposed within said first circumferential recess, for forming a sliding fluid-tight seal between said inner surface of said tubular housing and said valve sidewall;

a second seal means, disposed within said second circumferential recess, for forming a sliding fluid-tight seal between said inner surface of said tubular housing and said valve sidewall;

a third seal means, disposed within said third circumferential recess, for forming a sliding fluid-tight seal between an inner surface of said longitudinal aperture and said dart sidewall; and a fourth seal means, disposed within said fourth circumferential recess, for forming a sliding fluid-tight seal between an inner surface of said longitudinal aperture and said dart sidewall; and recording means, mechanically connected to said well testing valve, for recording bottom hole pressure.

6. The device of claim 5 wherein said equalizing dart further includes a first dart stop means for limiting the motion of said equalizing dart within said longitudinal aperture in a first direction, and a second dart stop means for limiting the motion of said equalizing dart within said longitudinal aperture in a second direction, said first and second dart stop means allowing said equalizing dart to move within said longitudinal aperture in a manner such that when said first dart stop means limits the motion of said equalizing dart within said longitudinal aperture in said first direction said radial aperture is in operational alignment with said second equalizing aperture, and when said second dart stop means limits the motion of said equalizing dart within said longitudinal aperture in said second direction said radial aperture is in operational alignment with a portion of said dart sidewall lying between said third and fourth seal means.

7. The device of claim 6 wherein said coupling means includes a screw mechanism.

8. The device of claim 6 wherein said first seal means has a width greater than the diameter of said port of said tubular housing, and said third seal means has a width greater than the diameter of said radial aperture.

* * * * *